US005911176A

United States Patent [19]

Buschulte

[11] Patent Number: 5,911,176

[45] **Date of Patent: *Jun. 15, 1999**

[54] CIRCUIT ARRANGEMENT FOR A REVERSIBLE IMAGE STRUCTURE OF A PRINTING FORM OF A PRINTING MACHINE

[75] Inventor: Rainer Buschulte, Bad Schönborn, Germany

[73] Assignee: Heidelberger Druckmaschinen AG, Heidelberg, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/020,570

[22] Filed: Feb. 22, 1993

[30] Foreign Application Priority Data

Feb. 21, 1992 [DE] Germany ..... 42 05 304

[51] Int. Cl.[6] ..... B41M 5/00

[52] U.S. Cl. ..... 101/467; 101/465

[58] Field of Search ..... 101/467, 465; 346/153.1, 155

[56] References Cited

U.S. PATENT DOCUMENTS

| | | | |
|---|---|---|---|
| 5,062,002 | 10/1991 | Dahlquist | 346/155 |
| 5,150,133 | 9/1992 | Ohigashi | 346/155 |
| 5,237,346 | 8/1993 | Da Costa et al. | 346/155 |

*Primary Examiner*—Edgar Burr
*Assistant Examiner*—Dave A. Ghatt
*Attorney, Agent, or Firm*—Herbert L. Lerner; Laurence A. Greenberg

[57] ABSTRACT

A circuit arrangement for a reversible image build-up of a surface matrix of a printing form for a printing machine, wherein the surface matrix has regions which are activatable and de-activatable by repeated triggering, includes a respective electrical circuit operatively associated with every region of the surface matrix activatable and de-activatable by the repeated triggering, at least one threshold value switch connected in each of the electrical circuits and having a switching state variable by the triggering for respectively activating and de-activating the region operatively associated therewith.

27 Claims, 6 Drawing Sheets

CIRCUIT ARRANGEMENT FOR A REVERSIBLE IMAGE STRUCTURE OF A PRINTING FORM OF A PRINTING MACHINE

The invention relates to a circuit arrangement for a reversible image structure of a surface or areal matrix of a printing form of a printing machine, wherein an electric circuit is assigned to every region of the surface matrix which is respectively activatable and de-activatable by repeated controlling actions.

From the published European patent document 0 367 048, a printing-machine printing form having a semiconductor layer has become known heretofore. Capacitive or inductive regions have been produced heretofore in this semiconductor layer by doping. By a suitable controlling action applied to the regions, they are charged and excited, respectively, depending upon whether they are capacitive regions or inductive regions. In the respectively charged and excited condition, ink, such as ferrofluid ink, for example, is fed by a suitable inking device to the printing form and adheres to the respectively charged and excited regions. By the discharge and deenergization, respectively, of the regions, they are able to be neutralized for effecting a change in the printing image.

The reversible image structure offers an advantage over classical printing forms in that a change in the printing image can be performed, preferably within the printing machine, in a relatively simple manner. The costly photochemical production of the classic printing forms, as well as installation and removal thereof, is no longer applicable.

A printing form for printing machines has become known heretofore from German Published Non-Prosecuted Application (DE-OS) 38 25 850 wherein hydrophobic (water-repellent) and hydrophilic (water-receptive) regions can be formed in accordance with an image to be printed. For this purpose, means are provided by which the regions, for the purpose of forming a printing copy electrochemically, are convertible from the hydrophobic to the hydrophilic state through the use of a current flow device acting preferably as a matrix. In this regard, provision is made for a hydrophobic polymer to be separated out on a hydrophilic carrier or to be removed from the carrier. Alternatively, it has, furthermore, become known from this publication, to separate a hydrophobic polymer or remove it from a hydrophilic carrier.

In all heretofore known circuit arrangements for a reversible image structure of an areal or surface matrix, a difficulty arises in forming a multiplicity of circuit and semiconductor architectures in a very small space, the formation thereof having to be over the total dimensions of the areal or surface matrix and, if necessary or desirable, taking into account the surface curvature (impression cylinder). It is thus questionable whether such circuit arrangements can be produced economically.

It is accordingly an object of the invention to provide a circuit arrangement of the foregoing general type having a relatively simple construction, producing optimal printing results and being economically manufacturable.

With the foregoing and other objects in view, there is provided, in accordance with the invention, a circuit arrangement for a reversible image build-up of a surface matrix of a printing form for a printing machine, wherein the surface matrix has regions which are activatable and de-activatable by repeated triggering, the circuit arrangement including a respective electrical circuit operatively associated with every region of the surface matrix activatable and de-activatable by the repeated triggering, and at least one threshold value switch connected in each of the electrical circuits and having a switching state variable by the triggering for respectively activating and de-activating the region operatively associated therewith.

This construction permits the installation of relatively simple circuit or switching elements, which are manufacturable free of any problem, and with which a functionally reliable operation is possible when the the circuit is relatively simply triggered. The installation, in accordance with the invention, of a threshold value switch permits the activation or de-activation, by relatively simple voltage application or increase, of a region for building up a printing image which is associated with the respective circuit. If the threshold value voltage for the threshold value switch is exceeded, the switching state of the switch is changed. In this regard, it is sufficient only briefly to exceed the threshold voltage, which preferably can be accomplished with a voltage pulse.

In accordance with another feature of the invention, therefore, means are provided for applying a voltage pulse to the respective electrical circuit for triggering the respective region.

If the threshold value switch has changed the switching state thereof, the change is maintained even though the threshold voltage is no longer applied to the threshold value switch, but rather, a lower voltage, namely, the holding voltage, is applied thereto. Thus, in a relatively simple manner, a switching state memory or storage has been realized. Moreover, such threshold value switches are able to be manufactured relatively simply, and the operation thereof is free of any problems and very reliable.

In accordance with a further feature of the invention, each of the regions is a pixel-type electrode.

This electrode is able to be activated by the desired triggering. For producing a printing image, the printing form is preferably provided with an inscription medium (for example, fluid or foil), the inscribing medium being connected via an electrolyte with a counter-electrode. The activation of the electrode causes the formation of a current path which penetrates the inscribing medium and extends through the electrolyte to the counter-electrode. It effects a break-up or transformation of the medium so that the latter has other properties or characteristics in the current path than in regions which are not traversed by a current. Due to the varying characteristics, hydrophilic and hydrophobic regions are able to develop which permit the application of a conventional printing process.

In accordance with an added feature of the invention, an x and a y-address line are operatively associated with each of the electrical circuits and are mutually connected via the threshold value switch.

In order to activate and deactivate, respectively, an individual or given region, it is necessary initially to select this region out of the multiplicity of regions of the surface matrix. This is effected by so-called addressing.

The x-address lines and the y-address lines are associated with the circuits so that via the matrix-type resulting selective control by means of the respective x and y-address lines, the desired circuit is controllable, i.e., addressable. Because the appertaining threshold value switch lies between the selected x and the selected y-address line, the switching state of the switch can be altered by triggering (for example, by means of a voltage pulse).

In accordance with an additional feature of the invention, means are provided for applying a holding voltage between the x and the y-address line, the holding voltage being briefly increasable by the voltage pulse for addressing the respective region, the state of the threshold value switch being switchable by the pulsed increase of the holding voltage, and the switched-over state of the threshold value switch being maintainable by the holding voltage after termination of the voltage pulse.

Accordingly, through the addressing, a specific or given electrical circuit is "selected", so that it is thereafter necessary only to activate the pixel-type electrode to effect an inscription of the printing form.

In accordance with yet another feature of the invention, an electronic switch and another threshold value switch connect one of the address lines to the other of the address lines.

The electronic switch is connected to one of the address lines, and the threshold value switch to the other of the address lines.

In accordance with yet a further feature of the invention, the electronic switch is a transistor.

In accordance with yet an added feature of the invention, the transistor is a field-effect transistor.

In accordance with yet an additional feature of the invention, a terminal is located between and interconnecting the electronic switch and the other threshold value switch, and means are provided for applying an inscribing control voltage to the terminal for activating the respective region of the surface matrix.

By applying the inscription control voltage between the terminal and the counter-electrode and y-address lines, the electronic switch is converted from the conductive into the blocking condition or state thereof.

Thus, in accordance with still another feature of the invention, the respective region is a pixel-type electrode, and a counter-electrode is electrically connectible with the pixel-type electrode, the electronic switch being convertible from a low-resistance conductive to a high-resistance blocking state thereof when the inscribing control voltage is applied between the terminal and the counter-electrode and y-address lines.

In accordance with still a further feature of the invention, the first-mentioned threshold value switch is serially connected with a further threshold value switch, and the pixel-type electrode is connected to the further threshold value switch.

In accordance with still an added feature of the invention, the first-mentioned threshold value switch is serially connected with a further threshold value switch, and the first-mentioned, the other and the further threshold value switches are constructed as semiconductor threshold value switches.

In accordance with still an additional feature of the invention, the semiconductor threshold value switches are varistors.

In accordance with another feature of the invention, the first-mentioned and the other threshold value switches are, respectively, first and second threshold value switches, a third threshold value switch is serially connected with the first threshold value switch, and an inscribing medium is disposed on the printing form, the first threshold value switch being convertible, by the addressing of the respective region, into a low-resistance state thereof, and the second and the third threshold value switches being, respectively, convertible into a low-resistance state thereof when the inscribing control voltage is applied between the terminal and the counter-electrode, an inscribing current path being formable thereby extending from the pixel-type electrode through the inscribing medium and to the counter-electrode.

Preferably, the hereinaforementioned electrolyte is disposed between the inscribing medium and the counter-electrode. The inscription current path affects the condition of the inscribing medium so that a previously hydrophilic region is transformed into an hydrophobic region, and a previously hydrophobic region into an hydrophilic region, respectively.

In order to realize the entire surface matrix, depending upon the size of the printing form, a suitable solution in processing technology for providing the control or triggering units and the circuits is required. The total size of the surface matrix, as well as the small dimensions of the individual regions (matrix surfaces with an edge or side length of 5 to 10 micrometers) exclude the possibility of a conventional component construction. Conventional circuit and semiconductor architectures in MOS, CMOS and MNOS-technology are based on monocrystalline semiconductor chips which, however, because of the total dimensions of the surface matrix and also the surface curvature (impression cylinder), are not transferable to a printing form for a printing machine. Although, due to developments in recent years, integrated circuits are no longer dependent upon monocrystalline wafers as starting material, economical production of large-area control or triggering units is shattered in its encounter with circuit lithography and related installation or systems technology.

Thus, in accordance with a further feature of the invention, respective circuits operatively associated with respective individual regions of the surface matrix are disposed on a surface structure of the printing form, the surface structure being formed with depressions and elevations.

In accordance with an added feature of the invention, the surface structure of the printing form constitutes a substrate.

Due to this special surface structure of the starting material, it is possible, by employing suitable production-process steps, which will be discussed hereinafter in greater detail, to produce the desired semiconductor architecture with conventional processing and installation or systems technology. Thus, large, curved matrices, formed of many simple and identical circuits, including appertaining address decoders, are able to be produced.

In accordance with an additional feature of the invention, the surface structure is formed with grooves.

In accordance with yet another feature of the invention, the grooves are disposed in mutually parallel relationship.

The grooves thus form the aforementioned depressions and, due to the mutually parallel relationship, form the aforementioned elevations therebetween.

The grooves may be formed by mechanical processing, especially by laser caving, partial surface coating and/or chemical or electrochemical etching.

In accordance with yet an added feature of the invention, the grooves are from 5 to 10 micrometers in width. Preferably, they are 7 to 8 micrometers wide, respectively.

In accordance with yet an additional feature of the invention, the printing form is constructed as an impression cylinder.

In accordance with still another feature of the invention, the grooves extend in peripheral direction of the impression cylinder.

In accordance with still a further feature of the invention, the impression cylinder comprises a substrate integral therewith.

In accordance with still an added feature of the invention, the substrate is formed of copper or a substance containing copper.

In accordance with an alternative feature of the invention, the substrate is formed of or contains at least one electrically conductive silicon substance.

In accordance with another feature of the invention, each of the grooves is subdivided into longitudinal sections, and a respective circuit is operatively associated with each of the sections.

In accordance with a further feature of the invention, means are provided defining isolation trenches formed in the surface structure for electrically separating from one another the longitudinal sections of the grooves, to a partial depth thereof.

Transversely to the individual grooves, i.e., in the longitudinal or axial direction of the impression cylinder, the elevations form boundaries or borders between the circuits which are arranged adjacent one another in this direction.

In accordance with an added feature of the invention, the respective circuit is received substantially within each of the longitudinal section of the grooves.

In accordance with an additional feature of the invention, the respective circuit has a layered architecture.

In accordance with a concomitant feature of the invention, an x and a y-address line are operatively associated with each of the electric circuits and are mutually connected via the threshold value, one of the address lines being located in the grooves beyond the depth of the isolation trenches. Other features which are considered as characteristic for the invention are set forth in the appended claims.

Although the invention is illustrated and described herein as embodied in a circuit arrangement for a reversible image structure of a printing form of a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 5:
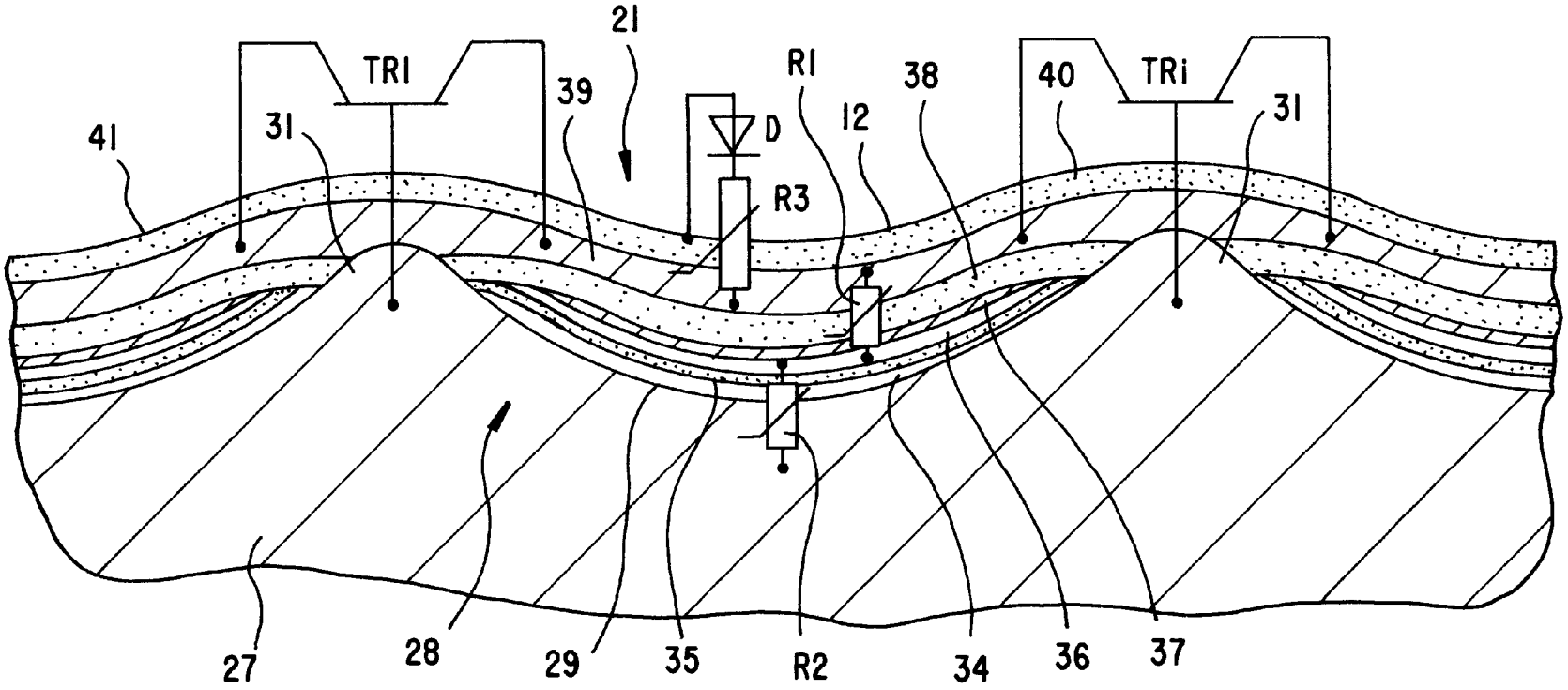
FIG. 5 is a cross-sectional view of the architecture of the circuit according to FIG. 3.
Figure 6:
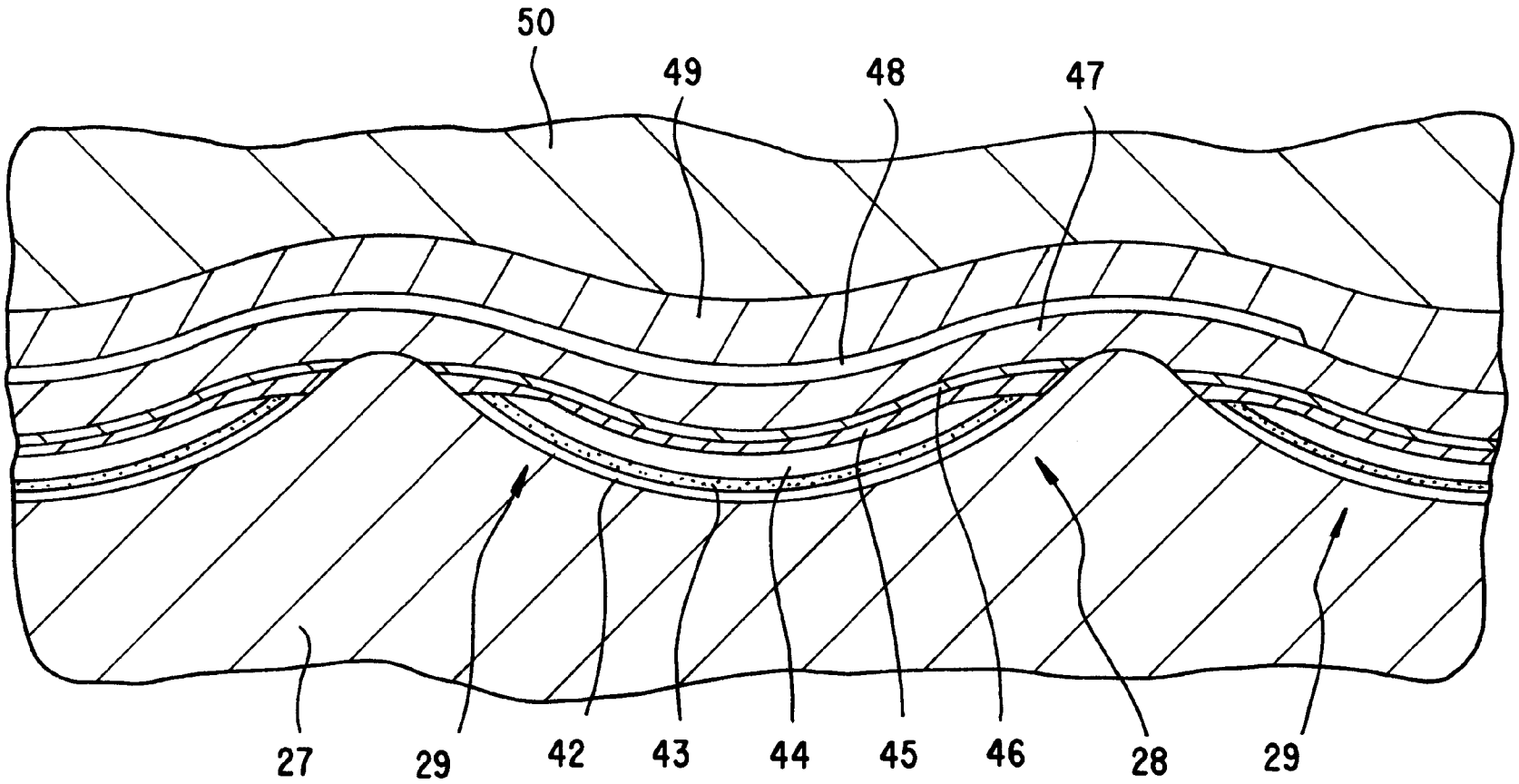
FIG. 6 is a view similar to that of FIG. 5 of the layer architecture of a decoder.
Figure 7:
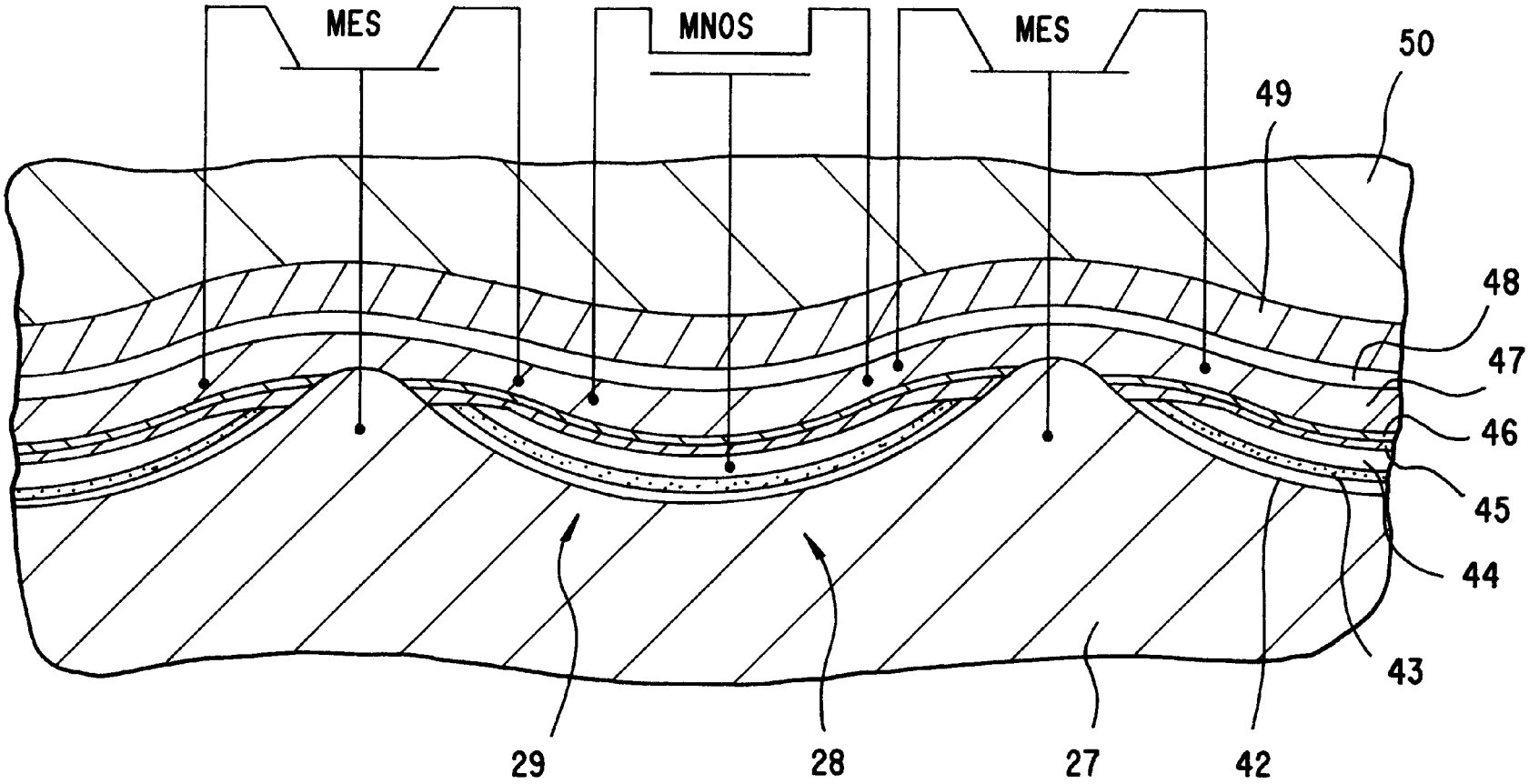
Figure 8:
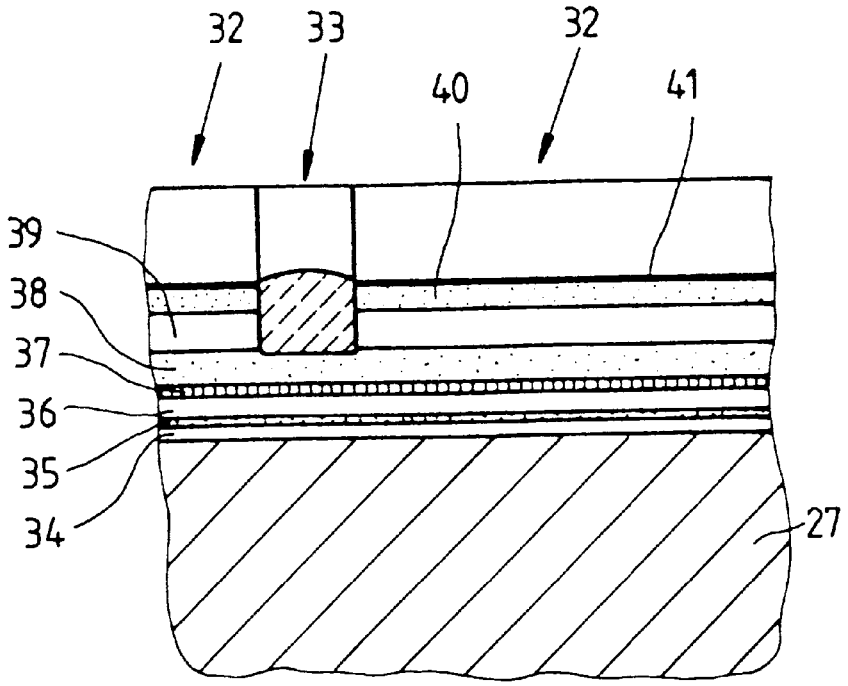
Figure 9:
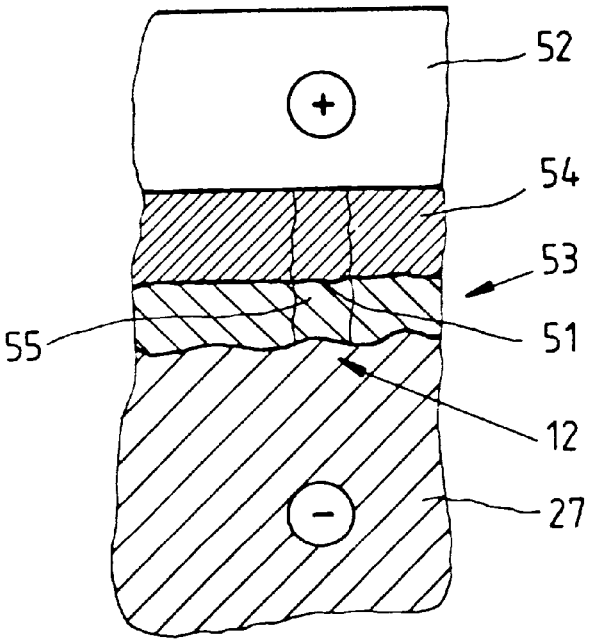

FIG. 7 is another view of FIG. 6 wherein the functions of individual layers of the decoder are shown symbolically superimposed thereon; and FIG. 8 is a fragmentary longitudinal sectional view of FIG. 5 taken along the line VIII—VIII; and FIG. 9 is an enlarged fragmentary view of FIG. 5 in combination with an electrolyte and a counter-electrode and representing, in principle, the marking or inscribing operation of the printing form according to the invention.

Figure 1:
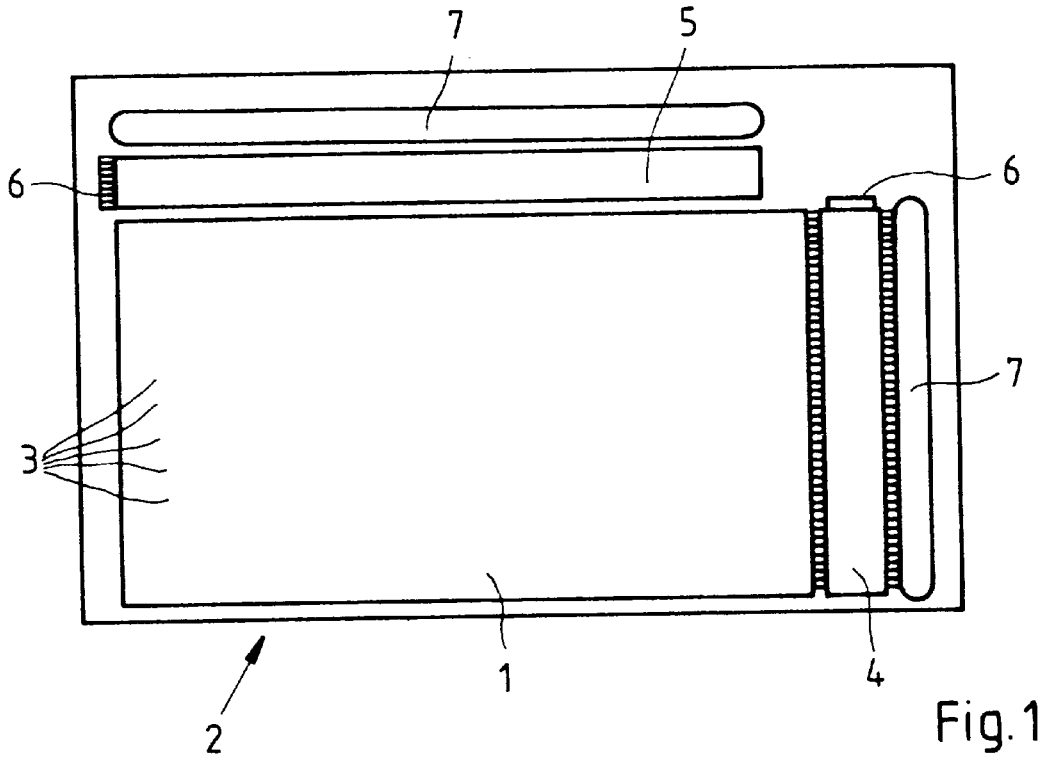
FIG. 1 is a top plan view of a developed projection of an areal or surface matrix of a printing form of a printing machine, in accordance with the invention.

Referring now to the drawings and, first, particularly to FIG. 1 thereof, a developed projection of an areal or surface matrix 1 of a printing form 2 of a printing machine is shown therein. The areal or surface matrix 1 serves for effecting the image formation or build-up, i.e., hydrophobic and hydrophilic regions, respectively, are produced in accordance with the subject of an image which is to be printed. In this regard, the surface matrix 1 has a multiplicity of activatable and deactivatable regions 3, the individual deactivatable regions of which being convertible from the the deactivatable to the activatable condition, and the individual activatable regions of which being convertible from the activatable to the deactivatable condition, by repeated controlling actions or triggerings. The individual regions 3 may have a square cross section with the edges thereof having a respective length of 5 micrometers, for example. For the requisite resolution, it is advantageous to provide as many regions 3 as possible within a surface element or unit area of the surface or areal matrix 1. In the illustrated embodiment of the invention, $3.3\times10^{10}$ regions 3 are formed in the areal or surface matrix 1. An x-decoder 4 and a y-decoder 5 are provided for controlling or triggering the individual regions 3 of the surface matrix 1. Both the x-decoder 4 and the y-decoder 5 are provided with an 18-bit interface 6. Respective current supplies 7 feed current to address lines of both the x-decoder 4 and the y-decoder 5.

As noted hereinbefore, the view of FIG. 1 is of a development or developed projection of an areal or surface matrix of a printing form, which means that the printing form per se, as disposed on an outer cylindrical surface of an impression cylinder of a printing machine is not in the development or developed projection form.

Figure 2:
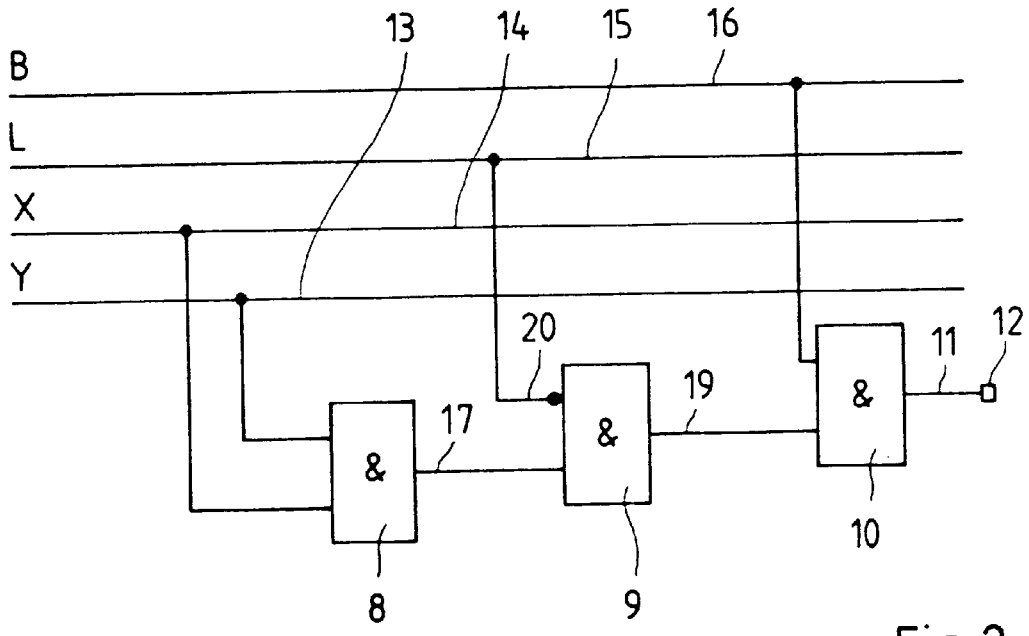
FIG. 2 is a block diagram serving to explain a reversible image structure of the areal or surface matrix.

The function of a respective region 3 of the surface matrix 1 is clarified in FIG. 2 with the aid of a logic circuit. Three AND-gates 8, 9 and 10 are represented in FIG. 2. The AND-gate 10 has an output 11 leading to a pixel-type electrode 12 which forms the respective region 3. In addition, command lines 13, 14, 15 and 16, which also bear the designations Y, X, L and B, respectively, are provided. The foregoing designations represent the following:

Y=y-address

X=x-address

L=cancel or clear

B=mark or inscribe

To locate an address, a matrix-type controlling action or triggering occurs, i.e., a multiplicity of x- and a multiplicity of y-address lines are provided. The respective address lines are more specifically identified as xl . . . xi . . . xn, yl . . . yi . . . ym, the value or amount n characterizing the number of the electrodes 12 of the surface matrix 1 disposed in the x-direction, and the value or amount m the number thereof disposed in the y-direction.

In order to activate a prescribed region 3, the appertaining x- and y-address lines (command lines 13 and 14, respectively) are triggered so that an addressing of the appertaining region 3 and, accordingly, the corresponding electrode 12, occurs. This address is permanently maintained as long as it is not reset by a command to cancel on the command line 15. Should the command or instruction "mark" or "inscribe" appear on the command line 16, activation of the appertaining electrode 12 results therefrom.

The hereinaforementioned functions are explained in greater detail hereinafter. The two command lines 13 and 14 assume the condition "logical 1" for the purpose of addressing. Thus, the condition "logical 1" is likewise present at an output 17 of the AND-gate 8. Presupposing that the condition "logical 0" is present on the command line 15, and the condition "logical 1" on the command line 16, i.e., a marking or inscribing/activation should occur, the condition "logical 1" then lies at both inputs of the AND-gate 10, respectively, so that this condition is also present at the output 11. The electrode 12 is thereby activated. If a cancelling operation should be performed, the command line 15 assumes the condition "logical 1". Because the AND-gate 9 is provided with an inverting input 20, an output 19 of the AND-gate 9 assumes the condition "logical 0" which is transmitted to a corresponding input of the AND-gate 10. Accordingly, the condition "logical 0" is also present at the output 11 of the AND-gate 10, i.e., the electrode 12 is not activated.

Figure 3:
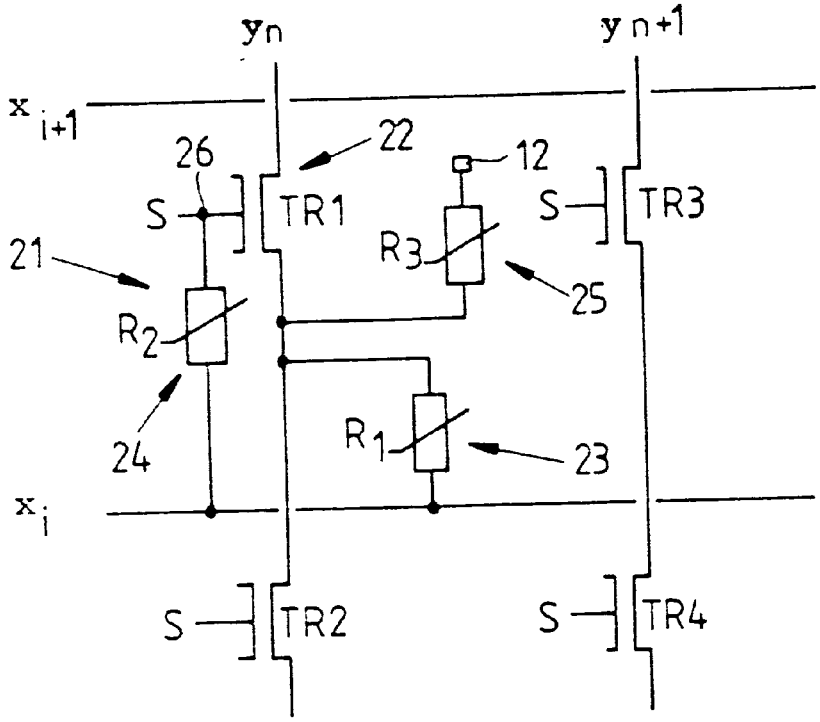
FIG. 3 is a diagram of a circuit for controlling an activatable and deactivatable region, respectively, of the areal or surface matrix.

FIG. 3 illustrates the construction of an electronic circuit 21. Such a circuit 21 is associated with each of the regions 3 of the areal or surface matrix. The address lines extend in a matrix-type manner. The address line xi and the address line yn are associated with the circuit 21 shown in FIG. 3. An electronic switch 22, a first threshold-value switch 23, a second threshold-value switch 24 and a third threshold-value switch 25 are connected in the circuit 21. The electronic switch 22 is constructed as a MES-FET transistor TR1. The threshold-value switches 23, 24 and 25 are semiconductor switches, namely varistors R2, R1 and R3. The MES-FET transistors TR2, TR3 and TR4 likewise shown in FIG. 3 belong to adjacent circuits 21, which, however, are identical with the circuit 21 shown in detail, so that it is unnecessary to go into further detail with respect thereto.

The varistor R1 is connected by one terminal thereof to the address line xi and by the other terminal thereof to the address line yn. The connection to the adjacent circuits 21 is effected via the electronic switch 22 and not, however, via the switching path thereof which is disposed, on the one hand, on the address line yn and, on the other hand, at a connection 26. The second threshold-value switch 24 (the varistor R2) lies in series with the switching path of the electronic switch 22, one of the terminals of the varistor R2 being connected to the connection or junction 26, and the other of the terminals to the address line xi. A substrate S, namely a printing form 27 (FIG. 4) is also connected to the junction or connection 26. A marking or inscription control voltage between the connection 26 and a counter-electrode 52 (FIG. 9) is applicable via the substrate S to the connection 26 and the address line xi. The third threshold-value switch 25 (the varistor R3) has one terminal at a connection between the electronic switch 22 and an appertaining terminal of the first threshold-value switch 23. The varistor R3 has another terminal which leads to the electrode 12, if necessary or desirable, via a non-illustrated diode.

The operations "addressing" and "marking" or "inscribing" are described hereinafter:

Addressing:

To address the switch 21, a basic voltage is applied between the address lines xi and yn. The substrate S lies at the same voltage level as the address line yn. A consequence thereof is that the switch 22 is connected through. For the addressing operation, the voltage applied between the address lines xi and yn and between the connection 26 and the address line xi is increased to such an extent that the threshold voltage of the varistors R2 and R1 is exceeded. The previously applied basic voltage is thus lower than the threshold voltage and is therefore insufficient for connecting or switching the varistors R1 and R2 through. The aforementioned voltage increase can be effected by a voltage pulse. Due to this voltage pulse, the varistors R1 and R2 pass from the highly resistive conductive state thereof into the low-resistance conductive state thereof. After the voltage pulse has died away, the new operating condition nevertheless survives due to the applied basic voltage (holding voltage). The circuit 21 is thereby addressed.

Alternatively to the aforedescribed self-holding, it is also possible, with the use of chalkogenide semiconductors, to produce a change in the switching condition through light or heat.

Marking or Inscribing:

For the marking or inscribing operation, i.e., for the activation of the electrode 12, a voltage difference is applied between the substrate S, the address line yn, as well as the electrode 12, which causes the electronic switch 22 to assume the non-conductive state thereof. The voltage applied between the substrate S and the electrode 12 shifts the varistor R3 likewise into the conductive state provided that, beforehand, as described hereinbefore, the varistors R1 and R2 are connected through. A current flow is then realized, which originates in the substrate S, passes through the varistor R1, the varistor R2 and the varistor R3 to the electrode 12 and, from the latter, results in the formation of a current path going through the marking or inscribing medium and the electrolyte and extending to the counter-electrode. The aforementioned voltage increase between the substrate S, the address line yn, as well as the electrode 12 hereby represents a marking or inscribing control voltage.

FIG. 9 shows, in a diagrammatic view, the construction of the aforementioned current path 51 which extends from the electrode 12 of the appertaining region 3 of the printing form 27 to a counter-electrode 52. A marking or inscribing medium 53, which may be a fluid or a foil, for example, is disposed on the printing form 27. An electrolyte 54 is applied between the inscribing medium 53 and the counter-electrode 52. By suitably forming the current path 51, the region 55 of the inscribing medium 53 encompassed by the current path 51 is varied in a manner that the preexisting hydrophilic property is converted into a hydrophobic property or the preexisting hydrophobic property is converted into a hydrophilic property. In this manner, the printing image can be produced on the surface of the printing form 27 by suitably triggering the electrodes 12. Once the printing image has been produced, the thus inscribed printing form 27 can be installed in a conventional manner for the printing process.

Figure 4:
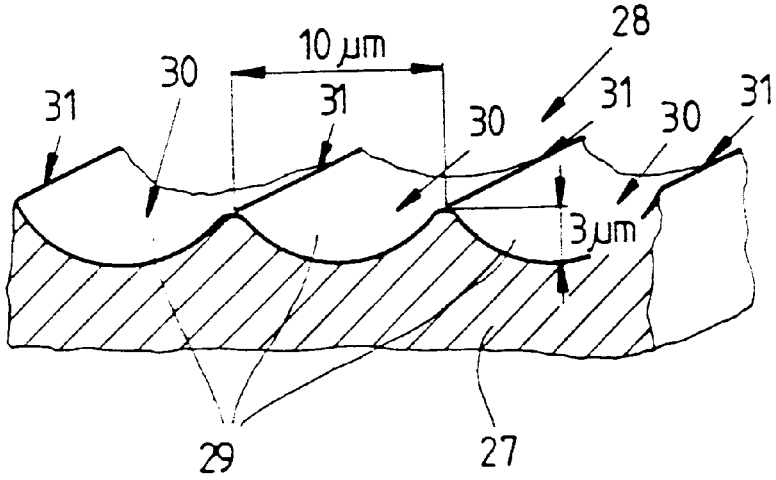
FIG. 4 is an enlarged perspective view, partly in cross section, of the surface structure of a substrate carrying the circuit of FIG. 3.

To manufacture the areal or surface matrix provided with a multiplicity of electronic circuits, the printing form 27 forming the substrate is provided with a surface structure 28. According to FIG. 4, this surface structure 28 is formed with a multiplicity of mutually parallel grooves 29 having depressions 30 located between respective elevations 31. The grooves 29 extend in peripheral direction of the printing form which is formed as an impression cylinder. The substrate S and the printing form 27, respectively, can consist of copper. Alternatively, it is also possible, however, that electrically conductive silicon substances form the material therefor. The spacing between the elevations 31 of respective pairs thereof defining the grooves 29 is 10 micrometers, as indicated in FIG. 4; the depth of the grooves 29, measured from the apex or crown of the elevations 31 to the base of the depressions 30, as shown also in FIG. 4, is 3 micrometers. The grooves 29 are formed by mechanical processing, such as, laser caving, especially, partial surface coating, i.e., applying or depositing the elevations 31, and/or chemical or electrochemical etching (etching the depressions 30).

FIG. 5 shows diagrammatically that the circuit 21 is in essence mounted in one of the grooves 29 and, in this regard, the contents of the respective groove 29 are shown in longitudinal cross section. This is apparent from FIG. 8 wherein the individual longitudinal sections are shown separated from one another by isolation trenches 33. To build up the layer or coating architecture of the circuit 21, the base member, i.e., the printing form 27, is provided with the aforementioned surface structure 28. The printing form 27 serves for supplying energy to the circuit 21; the material thereof being preferably metal, such as, copper, especially, or electrically conductive, coated glass or electrically conductive, coated ceramic. A contact layer 34 is disposed within the groove 29 and makes contact electrically with a succeeding layer 35 thereon which forms the varistor R2 according to FIG. 3. The layer 35 is made up of an amorphous or polycrystalline compound semiconductor. Layers 36 and 37 which are applied in succession thereto form the address line xi and constitute poly-silicon/silicide-polycide conductor paths. Superimposed on the foregoing layer 37 is a layer 38 which, at the edges thereof, overlaps the layers 34 to 37 and terminates just below half-way to the top of the respective elevation 31. The layer 38 forms the varistor R1 and is made up of an amorphous or polycrystalline compound semiconductor.

The next layer 39 covers the entire surface of the surface structure 38, the tops of the elevations 31 projecting into and being also covered by the layer 39. It is further noted that the layer 39 forms the address line yn. Another superimposed layer 40 is made up of an amorphous or polycrystalline compound semiconductor and forms the varistor R3. A cover layer 41 is then applied and serves as a passivating layer. The cover layer 41 is preferably formed of silicon dioxide. It is readily apparent from FIG. 8 that the isolation trenches 33 formed between longitudinal lengths or sections of the grooves 29 serve to limit or define respective surface elements or unit areas. Silicon dioxide, for example, is provided within the isolation trenches 33 as isolating or insulating material.

In summary, it is noted, therefore, according to FIG. 5, that the varistor R2 is formed between the printing form 27 forming the substrate S, and the layer 36. Moreover, the varistor R1 is formed between the layers 36 and 39, and the varistor R3 between the layer 39 and the surface of the layer 41, if necessary or desirable, with the added formation of a diode D. The electronic switch 22 which is made up of a MESFET transistor (TR1) is formed between the printing form 27 and the layer 39.

The construction of the decoder 4,5 differs from the layered architecture of the circuit 21, apart from the passivation, by a double layer of $SiO_2$, $Si_3N_4$ instead of the compound semiconductor layer, by a pure low n-Si-address line instead of a polycide build-up, and by an additional silicon dioxide and metal layer. The succession of materials of the double layer as a component of an MNOS-transistor is different in the respective x-decoders 4 and y-decoders 5, and is dependent upon which line is to function as the gate. Hereinafter, with respect to FIG. 6, the layered architecture of the decoder is described in greater detail.

According to FIG. 6, the build-up of layers of the decoder represented therein again begins with the printing form 27 forming the substrate S. Within the groove 29, an electrical contact layer 42 is provided. A layer 43 superimposed thereon is formed of amorphous or polycristalline compound semiconductor. A following layer 44 forms an x-address line; it is constituted of polysilicon and is conductively doped. A layer 45 forming a MNOS-gate isolation and consisting of $SiO_2$ or $Si_3N_4$ then follows. Applied thereto is another layer 46 which is likewise formed as a MNOS-gate isolation. It is formed principally of the same materials as the layer 45. A layer 47 then follows which represents the y-address line and is formed of conductively doped gallium arsenide (n-GaAs). A next layer 48 (for example, of $SiO_2$) serves as isolation. Another layer 49 applied to the latter forms a refresh control line which also serves as a current supply. It is formed of silicide or aluminum. The foregoing succession of superimposed layers are enclosed by a layer 50 which effects passivation ($SiO_2$, PSG). Altogether, it is clear that the layered architecture for the decoder of FIG. 6 most markedly resembles the layered architecture for the matrix cells according to FIG. 5. In order to be able to perform the decoding function, individual regions of the homogeneously constructed device of FIG. 6 are neutralized, i.e., a distinction is to be made between active and neutralized transistors in the vicinity of the respective grooves 29 formed in the surface structure 28. It is apparent from FIG. 6 that the layer 48 does not extend all the way to the right-hand side of the figure, i.e., not into the main part of the groove 29. In this respect, a neutralized transistor is located thereat.

The functions of the individual layers of an x-decoder 4 with regard to circuit technology are represented in FIG. 7. MES as well as MNOS-semiconductors are formed. In the case of a non-illustrated y-decoder, the line functions of the gate and the source/drain terminals are mutually exchanged.

Both the layered architecture according to FIG. 5, as well as that of FIG. 6, is capable of being relatively simply manufactured by mass production techniques. Therewith, it is no longer necessary to provide a multiplicity of accurately positioned lithographs for producing circuit structures, as well as chemical-physical etching processes, for obtaining true-to-size images or pictures with anisotropic etching, as has been required in the heretofore known state of the art. The production of the device according to the invention is limited to the following partly repeating operating steps:

a. physical or chemical surface structure production,
b. cleaning,
c. CVD-method of layer deposition,
d. varnish coating,
e. exposure or illumination, and
f. chemical etching.

In particular, one can preferably proceed as follows:

For producing the surface structure 28, a mechanical treatment or processing, a partial surface coating or a chemical or electrochemical etching can be instituted. The respectively employed method is determined primarily by the material and the construction of the printing form 27. The most important requirements for the material are wear resistance and temperature stability especially up to 800 degrees C. Glass, ceramic as sinter material or heat-resistant iron materials are examples of suitable material.

The cleaning step is performed chiefly in cleaning baths using ultrasonics. Such equipment may be made readily available without problem in workrooms having required dimensions.

A very simple method of layer or coating deposition which may be used is the conventional gas-phase deposition method. The so-called LPCVD-method (Low Pressure Chemical Vapor Deposition) is preferred.

The varnish coating is preferably performed by a conventional silk-screen process. Surface coatings with a coating or layer thickness of 10 to 15 micrometers, which optimally level the surface profile, are possible.

The layer architecture and production-process sequence require only the institution of wet-chemical and/or dry-chemical etching processes. Of course, the institution of physical-chemical etching technologies for an anisotropic treatment or processing is also possible. However, this is able to be performed only in devices having costly or large-scale structural engineering.

The doping of the circuits is realizable with LPCVD ovens. With partial coating, a doping which is to be performed regionwise or regionally is possible.

For exposure or illumination procedures, rotational illuminating machines conventional to modern printing-copy lithography can be installed.

Essential process steps for producing the surface matrix, together with the most important parameters, are provided in the following table:

| Process | Step | Equipment | Temp. ° C. |
|---|---|---|---|
| 1. n-Si-deposition | LPCVD | horizontal reactor | 500 650 |
| 2. compound semiconductor deposition | LPCVD | horizontal reactor | 500 750 |
| 3. Si-deposition | LPCVD | horizontal reactor | 500 650 |
| 4. Polymide deposition | silk-screening | | <100 |
| 5. Polymide melting | heating | oven | 500 900 |
| 6. Back etching -polymide -compound semiconductor -Si | chemical dry-etching | barrel-reactor | <100 |
| 7. Polymide removal | chemical dry-etching | barrel-reactor | <100 |
| 8. Selective silicide deposition | LPCVD | cold wall-reactor | 600 |
| 9. Compound semiconductor deposition | LPCVD | horizontal reactor | 500 750 |
| 10. Polymide deposition | silk-screening | | <100 |
| 11. Polymide melting | heating | oven | 500 900 |
| 12. Back etching -polymide -compound semiconductor | chemical dry-etching | barrel-reactor | <100 |
| 13. Polymide removal | chemical dry-etching | barrel-reactor | <100 |
| 14. n-GaAs -removal | LPCVD | horizontal reactor | 500 750 |
| 15. Compound semiconductor coating | LPCVD | horizontal reactor | <100 |
| 16. SiC-deposition | LPCVD | horizontal reactor | <100 |
| 17. Photoresist coating | silk-screening | | <100 |
| 18. Exposure or illumination | contact copy | UV-illuminating machine | <100 |
| 19. Developing | wet-chem. etching | etch bath | <100 |
| 20. Back etching -SiC -compound semiconductor -n-GaAs | chemical dry etching | barrel reactor | <100 |
| 21. $SiO_2$-trench filling | CVD-TEOS | horizontal reactor | 600 800 |
| 22. $SiO_2$-back etching | chemical dry etching | barrel reactor | <100 |

In the production of the decoder, special intermediate steps are to be performed with respect to the processes in the foregoing table. The references hereinafter are to the respective process numbers and represent intermediate steps associated with the respective processes:

8a. partial silicide back etching 9a. partial compound semiconductor back etching 9b,c. partial $SiO_2$ and $Si_3N_4$-coating by total surface coating and subsequent targeted back etching or by covering areas not to be coated by means of gas-phase deposition (CVD)

12a,b. back etching of $SiO_2$, $Si_3N_4$

14a. $SiO_2$-coating of decoder surface expanse 15a. compound semiconductor back etching of decoder surface expanse 15b. partial photoresist-coating 15c. exposure or illumination 15d. developing 15e. $SiO_2$ back etching 15f. Al or silicide-coating of decoder surface expanse 23. additional passivation.

I claim:

1. Circuit arrangement for a reversible image build-up of a surface matrix of a printing form for a printing machine, wherein the surface matrix has regions which are activatable and de-activatable by repeated triggering, the circuit arrangement including a respective electrical circuit operatively associated with every region of the surface matrix activatable and de-activatable by the repeated triggering, comprising at least one threshold value switch with variable resistance states connected in each of the electrical circuits, said threshold value switch being a varistor having a switching state variable by the triggering for varying the resistance of said threshold value switch between a lower and a higher resistance state for respectively activating and de-activating the region operatively associated therewith.

2. Circuit arrangement according to claim 1, including means for applying a voltage pulse to the respective electrical circuit for triggering the respective region.

3. Circuit arrangement according to claim 2, including an x and a y-address line operatively associated with each of the electrical circuits and being mutually connected via said threshold value switch.

4. Circuit arrangement according to claim 3, including an electronic switch and another threshold value switch connecting one of said address lines to the other of said address lines.

5. Circuit arrangement according to claim 4, including means for applying a holding voltage between said x and said y-address line, said holding voltage being briefly increasable by said voltage pulse for addressing the respective region, the state of said threshold value switch being switchable by the pulsed increase of said holding voltage, and the switched-over state of said threshold value switch being maintainable by said holding voltage after termination of said voltage pulse.

6. Circuit arrangement according to claim 5, including an electronic switch and another threshold value switch connecting one of said address lines to the other of said address lines, wherein said other threshold value switch is a second varistor.

7. Circuit arrangement according to claim 6, including a terminal located between and interconnecting said electronic switch and said other threshold value switch, and means for applying an inscribing control voltage to said terminal for activating the respective region of the surface matrix.

8. Circuit arrangement according to claim 7, wherein said first-mentioned threshold value switch is serially connected with a further threshold value switch, and said first-mentioned, said other and said further threshold value switches are constructed as semiconductor threshold value switches.

9. Circuit arrangement according to claim 7, wherein the respective region is a pixel-type electrode, and including a counter-electrode electrically connectible with said pixel-type electrode, said electronic switch being convertible from a low-resistance conductive to a high-resistance blocking state thereof when said inscribing control voltage is applied between said terminal and said counter-electrode and y-address lines.

10. Circuit arrangement according to claim 9, wherein said first-mentioned and said other threshold value switches are, respectively, first and second threshold value switches, and including a third threshold value switch serially connected with said first threshold value switch, and an inscribing medium disposed on the printing form, said first threshold value switch being convertible, by the addressing of the respective region, into a low-resistance state thereof, and said second and said third threshold value switches being, respectively, convertible into a low-resistance state thereof when said inscribing control voltage is applied between said terminal and said counter-electrode, an inscribing current path being formable thereby extending from said pixel-type electrode through said inscribing medium and to said counter-electrode.

11. Circuit arrangement according to claim 1, wherein each of the regions is a pixel-type electrode.

12. Circuit arrangement according to claim 11, wherein said first-mentioned threshold value switch is serially connected with a further threshold value switch, and said pixel-type electrode is connected to said further threshold value switch.

13. Circuit arrangement according to claim 1, wherein respective circuits operatively associated with respective individual regions of the surface matrix are disposed on a surface structure of the printing form, said surface structure being formed with depressions and elevations.

14. Circuit arrangement according to claim 13, wherein said surface structure of the printing form constitutes a substrate.

15. Circuit arrangement according to claim 13, wherein said surface structure is formed with grooves.

16. Circuit arrangement according to claim 15, wherein said grooves are disposed in mutually parallel relationship.

17. Circuit arrangement according to claim 15, wherein said grooves are from 5 to 10 micrometers in width.

18. Circuit arrangement according to claim 15, wherein said grooves extend in peripheral direction of said impression cylinder.

19. Circuit arrangement according to claim 15, wherein each of said grooves is subdivided into longitudinal sections, and a respective circuit is operatively associated with each of said sections.

20. Circuit arrangement according to claim 19, including means defining isolation trenches formed in said surface structure for electrically separating from one another said longitudinal sections of said grooves, to a partial depth thereof.

21. Circuit arrangement according to claim 20, including an x and a y-address line operatively associated with each of the electric circuits and being mutually connected via said threshold value, one of said address lines being located in said grooves beyond the depth of said isolation trenches.

22. Circuit arrangement according to claim 19, wherein the respective circuit is received substantially within each of said longitudinal section of said grooves.

23. Circuit arrangement according to claim 22, wherein the respective circuit has a layered architecture.

24. Circuit arrangement according to claim 1, wherein the printing form is constructed as an impression cylinder.

25. Circuit arrangement according to claim 24, wherein said impression cylinder comprises a substrate integral therewith.

26. Circuit arrangement according to claim 25, wherein said substrate is formed of copper or a substance containing copper.

27. Circuit arrangement according to claim 25, wherein said substrate is formed of or contains at least one electrically conductive silicon substance.

* * * * *